US010254031B2

(12) United States Patent
Jeong et al.

(10) Patent No.: US 10,254,031 B2
(45) Date of Patent: Apr. 9, 2019

(54) REFRIGERATOR

(71) Applicant: SAMSUNG ELECTRONICS CO., LTD., Gyeonggi-do (KR)

(72) Inventors: Jin Jeong, Gyeonggi-do (KR); Jae Seung Lee, Gyeonggi-do (KR); Yoon Young Kim, Gyeonggi-do (KR); Yong Jong Park, Gyeonggi-do (KR); Kook Jeong Seo, Seoul (KR); Do Yun Jang, Gyeonggi-do (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/575,223

(22) PCT Filed: May 12, 2016

(86) PCT No.: PCT/KR2016/005004
§ 371 (c)(1),
(2) Date: Nov. 17, 2017

(87) PCT Pub. No.: WO2016/186374
PCT Pub. Date: Nov. 24, 2016

(65) Prior Publication Data

US 2018/0149398 A1 May 31, 2018

(30) Foreign Application Priority Data

May 20, 2015 (KR) ..... 10-2015-0070330

(51) Int. Cl.
*F25C 1/04* (2018.01)
*F25C 5/20* (2018.01)
(Continued)

(52) U.S. Cl.
CPC ..... *F25C 1/04* (2013.01); *F25C 5/182* (2013.01); *F25C 5/22* (2018.01); *F25D 13/04* (2013.01);
(Continued)

(58) Field of Classification Search
CPC .... F25D 23/062; F25D 13/04; F25D 2400/14; F25C 1/04; F25C 5/182
See application file for complete search history.

(56) References Cited

U.S. PATENT DOCUMENTS

2006/0090496 A1* 5/2006 Adamski ..... F25C 5/005 62/344
2006/0162369 A1 7/2006 Chae
(Continued)

FOREIGN PATENT DOCUMENTS

JP 2001-280836 10/2001
JP 2014-006000 1/2014
(Continued)

OTHER PUBLICATIONS

International Search Report dated Aug. 26, 2016 in corresponding International Application No. PCT/KR2016/005004 (2 pages).
(Continued)

*Primary Examiner* — Elizabeth J Martin
(74) *Attorney, Agent, or Firm* — Staas & Halsey LLP

(57) ABSTRACT

Disclosed is a refrigerator having a first storage chamber, a second storage chamber located below the first storage chamber, an ice maker configured to make ice pieces, an ice bucket configured to store the ice pieces made in the ice maker and a middle wall partitioning inside space of the refrigerator into the first storage chamber and the second storage chamber and including a base portion and a stepped portion located higher than the base portion to form ice-making space, wherein at least one portion of the ice maker
(Continued)

and at least one portion of the ice bucket are accommodated in the ice-making space. With this structure, the space for actual use of the first storage chamber can be increased.

11 Claims, 10 Drawing Sheets

(51) Int. Cl.
*F25C 5/182* (2018.01)
*F25D 13/04* (2006.01)
*F25D 23/06* (2006.01)

(52) U.S. Cl.
CPC ..... *F25D 23/06* (2013.01); *F25D 23/062* (2013.01); *F25D 2400/04* (2013.01)

(56) References Cited

U.S. PATENT DOCUMENTS

2006/0162427 A1* 7/2006 Horie ..... F25B 49/005 73/40.7
2008/0053138 A1* 3/2008 Ryu ..... F25C 5/22 62/344
2012/0174613 A1 7/2012 Park et al.

FOREIGN PATENT DOCUMENTS

| | | |
|---|---|---|
| KR | 10-2005-0022804 | 3/2005 |
| KR | 10-2006-0085985 | 7/2006 |
| KR | 10-2013-0101371 | 9/2013 |
| KR | 10-2015-0048349 | 5/2015 |
| WO | WO 2015/056977 | 4/2015 |

OTHER PUBLICATIONS

Written Opinion of the International Searching Authority dated Aug. 26, 2016 in corresponding International Application No. PCT/KR2016/005004 (6 pages).
European Search Report in Application No. 16796701.7 dated Apr. 3, 2018 (7 pages).
Korean Office Action dated Nov. 20, 2018 in corresponding Korean Patent Application No. 10-2015-0070330.
European Patent Office issued Office Action (Communication pursuant to Article 94(3) EPC in European Application No. 16796701.7 dated Oct. 15, 2018 (5 total pages).

* cited by examiner

REFRIGERATOR

CROSS-REFERENCE TO RELATED APPLICATION

This application is a U.S. National Stage Application, which claims benefit under 35 U.S.C § 371 of International Patent Application No. PCT/KR2016/005004 filed May 12, 2016, which claims the foreign priority benefit under 35 U.S.C. § 119 of Korean Patent Application No. 10-2015-0070330 filed May 20, 2015, the contents of which are incorporated herein by reference.

TECHNICAL FIELD

The present invention relates to a refrigerator having an ice maker for making ice pieces and a dispenser for providing the ice pieces made in the ice maker.

BACKGROUND ART

In general, a refrigerator includes storage chambers for storing foods and a cool air supply apparatus for supplying cool air to the storage chambers to maintain foods fresh. The storage chambers include a refrigerating chamber that is maintained at about 0° C. to 5° C. to keep foods refrigerated, and a freezing chamber that is maintained at about 0° C. to −30° C. to keep foods frozen.

Refrigerators are classified according to the positions of the refrigerating chamber and the freezing chamber and door types. That is, refrigerators are classified into a Bottom Mounted Freezer (BMF) type in which a refrigerating chamber is located in the upper portion and a freezing chamber is located in the lower portion, a Top Mounted Freezer (TMF) type in which a refrigerating chamber is located in the lower portion and a freezing chamber is located in the upper portion, and a Side By Side (SBS) type in which a freezing chamber is located in the left portion and a refrigerating chamber is located in the right portion. BMF type refrigerators include a French Door Refrigerator (FDR) type in which a pair of refrigerating chamber doors are provided to open or close a refrigerating chamber, and a four door type in which a pair of refrigerating chamber doors and a pair of freezing chamber doors are respectively provided to open or close a refrigerating chamber and a freezing chamber.

Recently, many refrigerators include an ice maker for making ice pieces, and a dispenser for supplying the ice pieces made in the ice maker to the outside of a main body.

In the BMF type refrigerator, generally, an ice-making room is formed in a corner of a refrigerating chamber and insulated from the refrigerating chamber, and an ice maker is installed in the ice-making room. Also, a dispenser is installed in a refrigerating chamber door so that ice pieces made in the ice maker are discharged to the outside of a main body through the dispenser.

In this structure, since the ice maker, an ice bucket, etc. are disposed in the refrigerating chamber, use space of the refrigerating chamber which is relatively more frequently used than a freezing chamber is reduced, and particularly, the ice maker, the ice bucket, etc. protrude in the corner of the refrigerating chamber to thereby deteriorate space utilization of the refrigerating chamber. Also, the entire front surface of the ice bucket is exposed to the outside, resulting in a lack of aesthetic sense.

DISCLOSURE

Technical Problem

An aspect of the present disclosure is to provide a refrigerator having a first storage chamber located in the upper portion and a second storage chamber located in the lower portion, wherein an ice maker and a dispenser are installed in the second storage chamber to increase use space of the first storage chamber and to make better space utilization.

Technical Solution

In accordance with an aspect of the present disclosure, a refrigerator include a first storage chamber; a second storage chamber located below the first storage chamber; an ice maker configured to make ice pieces; an ice bucket configured to store the ice pieces made in the ice maker; and a middle wall partitioning inside space of the refrigerator into the first storage chamber and the second storage chamber, and including a base portion, and a stepped portion located higher than the base portion to form ice-making space, and at least one portion of the ice maker and at least one portion of the ice bucket are accommodated in the ice-making space.

A length in front-rear direction of the stepped portion may be longer than half a length in front-rear direction of the middle wall.

The ice maker may extend in a front-rear direction.

The ice maker may extend in a left-right direction.

The ice bucket may extend in a front-rear direction.

The refrigerator may further include a transfer apparatus configured to transfer the ice pieces stored in the ice bucket.

The transfer apparatus may include a transfer shaft inclined upwardly in a front direction.

The refrigerator may further include an ice lifting apparatus configured to raise the ice pieces stored in the ice bucket upward.

The first storage chamber may be a refrigerating chamber, and the second storage chamber may be a freezing chamber.

The stepped portion may include a first stepped portion located higher than the base portion to form first ice-making space, and a second stepped portion located higher than the first stepped portion to form second ice-making space, and the at least one portion of the ice bucket may be accommodated in the first ice-making space, and the at least one portion of the ice maker may be accommodated in the second ice-making space.

Advantageous Effects

According to a technical concept of the present disclosure, in the refrigerator having the first storage chamber located in the upper portion and the second storage chamber located in the lower portion, the ice maker, the ice bucket, etc. may be installed in the second storage chamber to thereby increase use space of the first storage chamber and to make better space utilization.

According to another technical concept of the present disclosure, in the refrigerator having the first storage chamber located in the upper portion and the second storage chamber located in the lower portion, the ice maker, the ice bucket, etc. may be hidden in the ice-making space of the middle wall to thereby improve the aesthetic sense.

BEST MODE

Hereinafter, preferred embodiments of the present disclosure will be described in detail.

Figure 1:
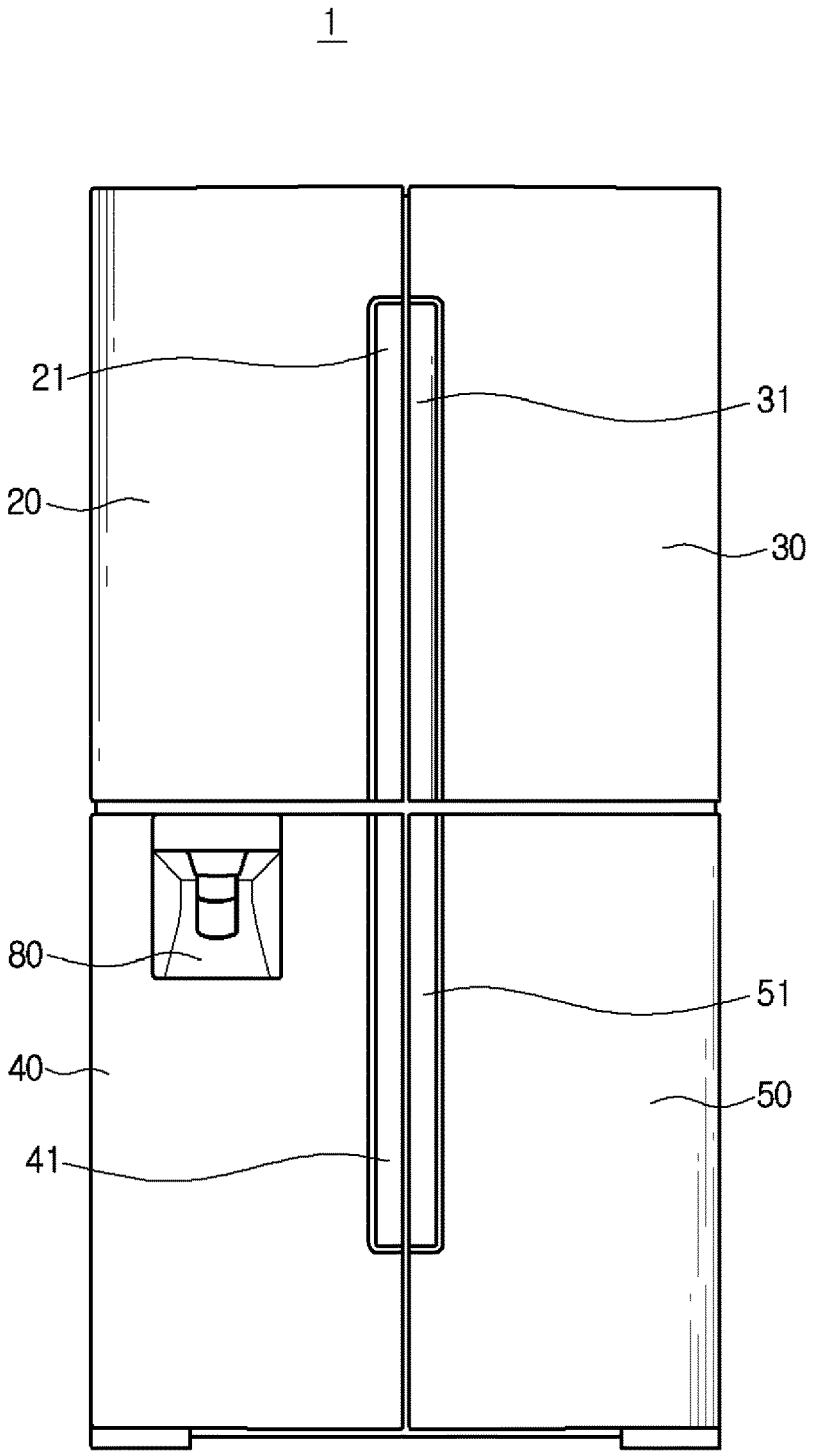
FIG. 1 is a front view showing an outer appearance of a refrigerator according to a first embodiment of the present disclosure.
Figure 2:
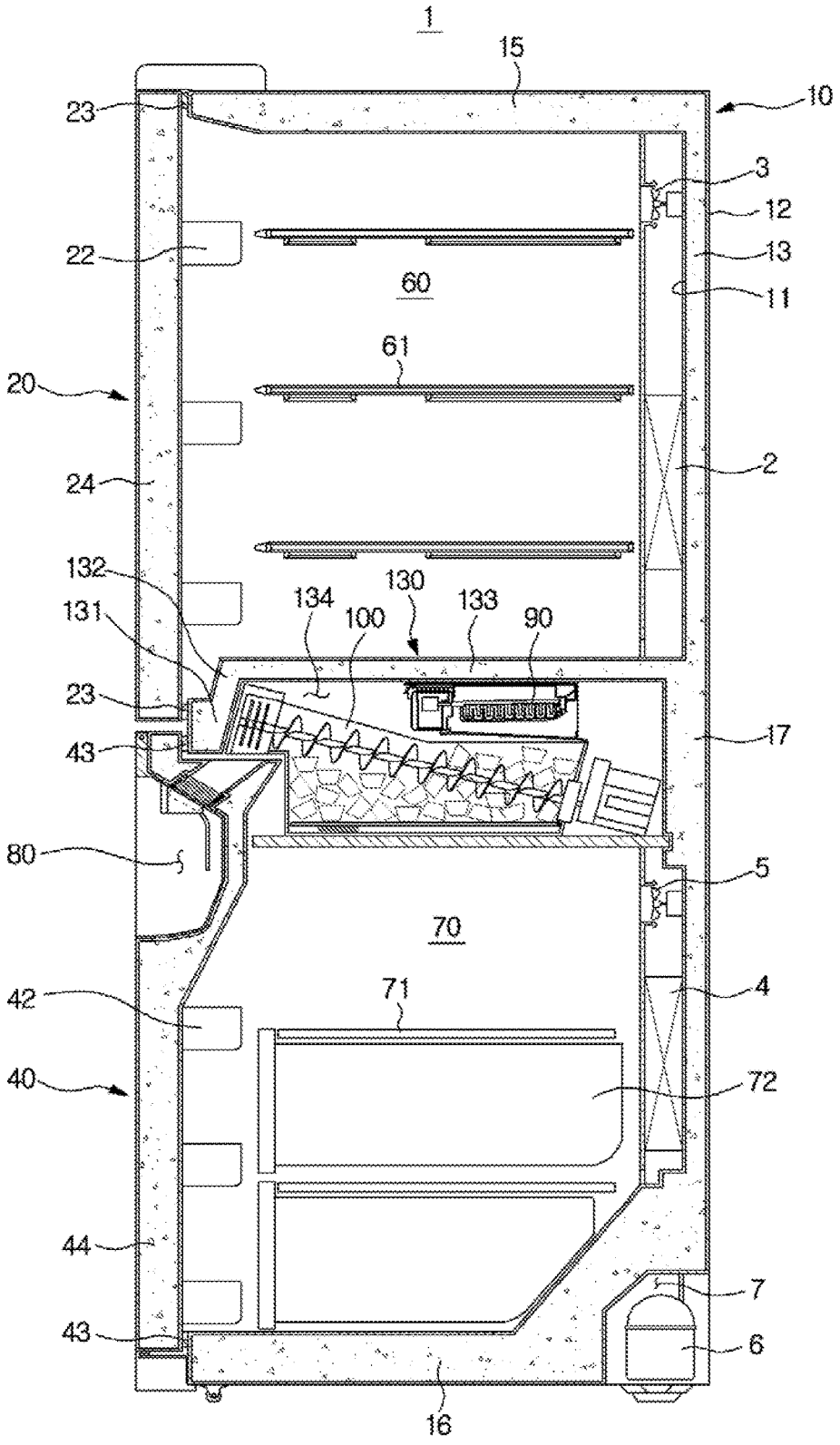
FIG. 2 is a side cross-sectional view showing main components of the refrigerator according to the first embodiment of the present disclosure.
Figure 3:
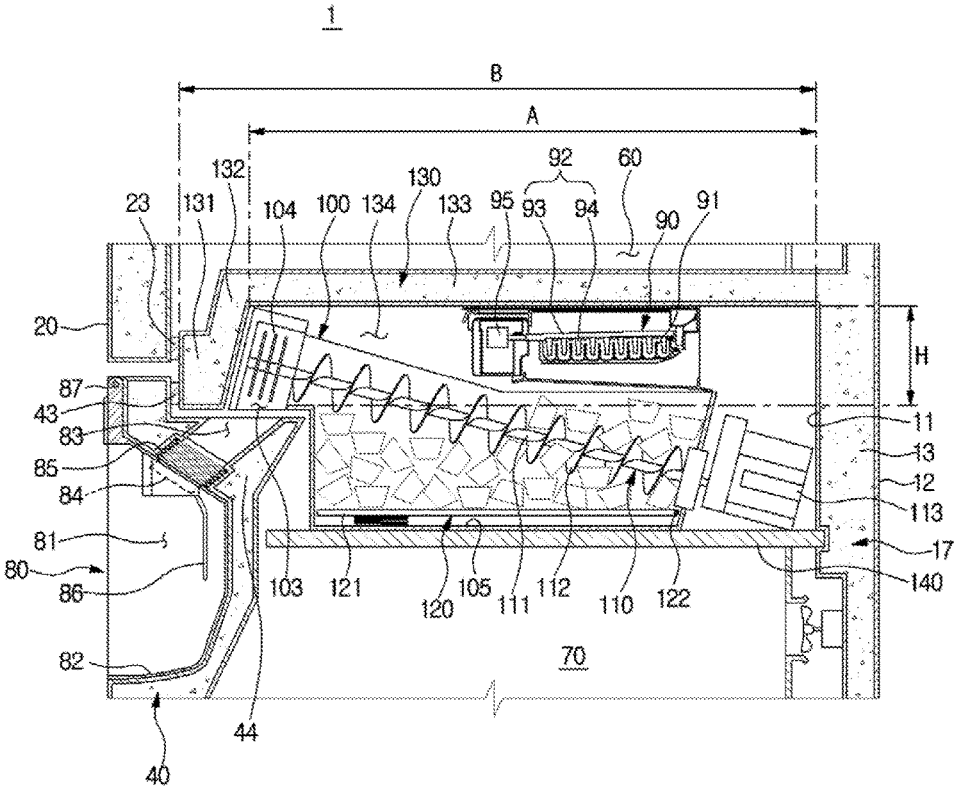
FIG. 3 is a side cross-sectional view showing a main portion of the refrigerator according to the first embodiment of the present disclosure.
Figure 4:
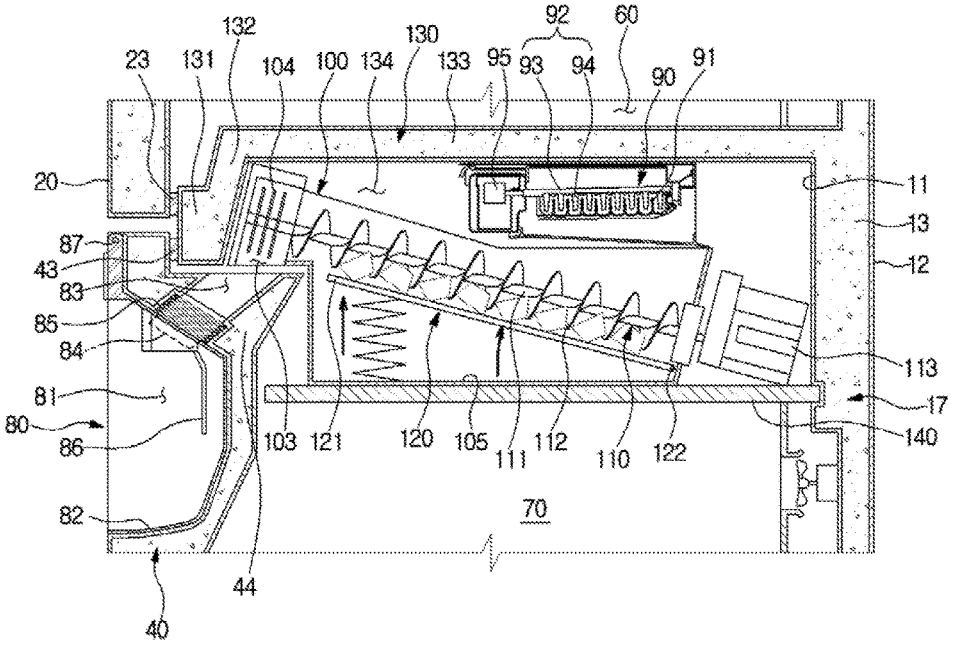
FIG. 4 is a view for describing operation of an ice lifting apparatus of the refrigerator according to the first embodiment of the present disclosure.

FIG. 1 is a front view showing an outer appearance of a refrigerator according to a first embodiment of the present disclosure. FIG. 2 is a side cross-sectional view showing main components of the refrigerator according to the first embodiment of the present disclosure. FIG. 3 is a side cross-sectional view showing a main portion of the refrigerator according to the first embodiment of the present disclosure. FIG. 4 is a view for describing operation of an ice lifting apparatus of the refrigerator according to the first embodiment of the present disclosure.

A refrigerator 1 according to a first embodiment of the present disclosure may include a main body 10, a first storage chamber 60, a second storage chamber 70 disposed below the first storage chamber 60, a plurality of first doors 20 and 30 to open or close the first storage chamber 60, a plurality of second doors 40 and 50 to open or close the second storage chamber 70, and a cool air supply apparatus to supply cool air to the first storage chamber 60 and the second storage chamber 70.

The first storage chamber 60 may be a refrigerating chamber, and the second storage chamber 70 may be a freezing chamber. The first doors 20 and may be refrigerating chamber doors, and the second doors 40 and 50 may be freezing chamber doors. That is, the refrigerator 1 may be a Bottom Mounted Freezer (BMF) type refrigerator having four doors.

However, a technical concept of the present disclosure is not applied only to such a BMF type refrigerator having four doors, and may be applied to any other type of a refrigerator regardless of the number or shape of doors, as long as the refrigerator has independent storage chambers in the upper and lower portions. For example, the technical concept of the present disclosure may be applied to a Top Mounted Freezer (TMF) type refrigerator, as well as the BMF type refrigerator.

The main body 10 may include an inner case 11 forming the refrigerating chamber 60 and the freezing chamber 70, an outer case 12 coupled with the outer portion of the inner case 11, and an insulating material 13 filled between the inner case 11 and the outer case 12. The outer case 12 may be formed of a metal material having high strength and excellent aesthetic sense, and the inner case 11 may be formed of a plastic material. The insulating material 13 may be a urethane foam insulating material or a vacuum insulating material.

In another aspect, the main body 10 may be in the shape of a box whose front side opens, and may include a top wall 15, a bottom 16, a rear wall 17, left and right side walls, and a middle wall 130 partitioning inside space into the refrigerating chamber 60 and the freezing chamber 70.

The refrigerating chamber 60 and the freezing chamber 70, which are storage chambers for storing foods, may be divided according to use, inside temperature, etc. The refrigerating chamber 60 may be a storage chamber for keeping foods refrigerated without freezing them, and may be maintained at about 0° C. to 5° C. The freezing chamber 70 may be a storage chamber for keeping foods frozen, and may be maintained at about 0° C. to −30° C.

Since the freezing chamber 70 has a greater temperature difference from indoor temperature than the refrigerating chamber 60, a thickness of the insulating material surrounding the freezing chamber 70 may be thicker than that of the insulating material surrounding the refrigerating chamber 60.

A size of the refrigerating chamber 60 may be larger than that of the freezing chamber 70. The reason is because foods that need to be kept in the refrigerating chamber 60 are generally more than foods that need to be kept in the freezing chamber 70.

In the refrigerating chamber 60 and the freezing chamber 70, a plurality of shelves 61 and 71 may be arranged to put foods thereon, and a box 71 may be provided to form closed space to store foods.

The doors 20, 30, 40, and 50 may be rotatably hinge-coupled with the main body 10. On the front surfaces of the doors 20, 30, 40, and 50, a plurality of handles 21, 31, 41, and 51 may be provided to enable a user to grip them to open or close the doors 20, 30, 40, and 50. The doors 20, 30, 40, and 50 may have insulating materials 24 and 44 to insulate the storage chambers 60 and 70. The insulating materials 44 included in the doors 40 and 50 of the freezing chamber 70 may have a thicker thickness than the insulating materials 24 of the doors 20 and 30 of the refrigerating chamber 60.

The doors 20, 30, 40, and 50 may have a plurality of door guides 22 and 42 formed on the rear surfaces to store foods. On the rear surfaces of the doors 20, 30, 40, and 50, a plurality of gaskets 23 and 43 may be disposed to close the storage chambers 60 and 70 by closely contacting the main body 10.

The gaskets 23 and 43 may be formed of a rubber material, and disposed on the edges of the rear surfaces of the doors 20, 30, 40, and 50. Magnets may be disposed in the insides of the gaskets 23 and 43 so that the doors 20, 30, 40, and 50 can be maintained in close contact with the main body by a magnetic force.

In any one of the doors 40 and 50 of the freezing chamber 70, a dispenser 80 may be disposed. The dispenser 80 may provide ice pieces made in the ice maker 90 which will be described later to the outside of the freezing chamber 70. That is, a user may receive ice pieces through the dispenser 80 without having to open the freezing chamber doors 40 and 50.

The dispenser 80 may include dispensing space 81 recessed in the front surface of the freezing chamber door 40 to supply ice pieces, a container tray 82 on which a container for receiving ice pieces can be put, a chute 83 penetrating the freezing chamber door 40 to guide ice pieces, and an ice discharging nozzle 84 to discharge ice pieces to the discharging space 81. The dispenser 80 may further include a lever 86 to operate the dispenser 80, and a flexible extention hose 85 connecting the chute 83 to the ice discharging nozzle 84.

The dispenser 80 may supply water, as well as ice pieces.

The dispenser 80 may be preferably disposed in an uppermost portion of the freezing chamber door 40, for ease of use. The reason is because the user suffers from inconvenience that he/she has to bend at the waist or sit when using the dispenser 80, if the dispenser 80 is disposed at a low position. The location of the dispenser 80 may be preferably higher than a center line in height direction of the freezing chamber door 40.

The cool air supply apparatus may generate cool air using evaporative latent heat of refrigerants, and supply the cool air to the refrigerating chamber 60 and the freezing chamber 70. The cool air supply apparatus may include a compressor 6, a condenser (not shown), an expander (not shown), a plurality of evaporators 2 and 4, and a plurality of blow fans 3 and 5. The compressor 6 may be installed in a machine room 7 formed in a rear, lower portion of the main body 10.

The refrigerator 1 may include the ice maker 90 to make ice pieces, and an ice bucket 100 to store ice pieces made in the ice maker 90.

The ice maker 90 may be an automatic ice maker to supply water, make ice pieces, and transfer the ice pieces automatically. The ice maker 90 may include an ice-making tray 91 having a plurality of ice-making cells to receive and freeze water, an ejector 92 to transfer ice pieces made in the ice-making tray 91 from the ice-making tray 91, and an ice transfer motor 95 to provide a rotational force to the ejector 92.

The ejector 92 may include an ejector shaft 93 to rotate by receiving a rotational force from the ice transfer motor 95, and an ejector pin 94 protruding in a radial direction of the ejector shaft 93 to gather and raise ice pieces from the ice-making tray 91.

The ice maker 90 may make ice pieces by an indirect cooling method or a direct cooling method. That is, the ice-making tray 91 may be frozen by cool air of the freezing chamber 70, or contact a refrigerant tube directly to receive freezing energy from the refrigerant tube.

The ice bucket 100 may be disposed below the freezing tray 91 to store ice pieces transferred from the freezing tray 91. Accordingly, the ice bucket 100 may be in the shape of a box whose top side opens. The ice bucket 100 may include a full ice sensor (not shown) to detect whether the ice bucket 100 is full of ice pieces.

The ice bucket 100 may include a transfer apparatus 110 to transfer the stored ice pieces. The transfer apparatus 110 may transfer the ice pieces stored in the ice bucket 100 in a front direction in order to discharge the ice pieces through the dispenser 80.

The transfer apparatus 110 may be configured with a transfer shaft 111, a spiral blade 112 protruding with a spiral form in a radial direction from the transfer shaft 111, and a transfer motor 113 to provide a rotational force to the transfer shaft 111.

If the transfer motor 113 is driven, the transfer shaft 111 and the spiral blade 112 may rotate, and the spiral blade 112 may transfer the ice pieces along an axial direction of the transfer shaft 111.

The ice maker 90 and the ice bucket 100 may be disposed in the ice-making space 134 formed by the middle wall 130. More specifically, at least one portion of the ice maker 90 and at least one portion of the ice bucket 100 may be accommodated in the ice-making space 134.

The middle wall 130 may be a portion of the main body 10, and protrude in the front direction from the rear wall 17. The middle wall 130 may partition inside space into the upper refrigerating chamber 60 and the lower freezing chamber 70, and function to support the doors 20, 30, 40, and 50 in close contact with the doors 20, 30, 40, and 50.

The middle wall 130 may include the insulating material 13 therein to insulate the refrigerating chamber 60 and the freezing chamber 70.

The middle wall 130 may include a base portion 131, and a stepped portion 133 that is higher than the base portion 131 to form the ice-making space 134. The stepped portion 133 may be nearly horizontal to the base portion 131 with a predetermined height difference H (see FIG. 3) from the base portion 131. The predetermined height difference may be a height difference between a lowest surface of the base portion 131 and a lowest surface of the stepped portion 133.

The ice-making space 134 may be surrounded by the base portion 131, the stepped portion 133, and the rear wall 17 such that the lower area opens. The ice-making space 134 may be an area in the freezing chamber 70.

An extention portion 132 may be formed between the base portion 131 and the stepped portion 133. The extention portion 132 may be formed by bending the base portion 131, and the stepped portion 133 may be formed by bending the extention portion 132. The extention portion 132 may be inclined or formed at right angles to the base portion 131.

The doors 20 and 30 of the refrigerating chamber 60 and the doors 40 and 50 of the freezing chamber 70 may be supported on the base portion 131 in close contact with the base portion 131. That is, the gasket 23 of the refrigerating chamber doors 20 and 30 and the gasket 43 of the freezing chamber doors 40 and 50 may be in close contact with the base portion 131.

Due to the bent shape of the middle wall 130, the ice-making space 134 may be formed, and at least one portion of the ice maker 90 and at least one portion of the ice bucket 100 may be accommodated in the ice-making space 134. In the current embodiment, the entire of the ice maker 90 may be accommodated in the ice-making space 134, and a portion of a front end of the ice bucket 100 may be accommodated in the ice-making space 134, although not limited to this.

The ice maker 90 may extend in a front-rear direction. That is, the ejector shaft 93 of the ice maker 90 may extend in the front-rear direction. The ice maker 90 may be fixed on a lower surface of the middle wall 130.

The ice bucket 100 may extend in the front-rear direction.

In the front end of the ice bucket 100, a grinding knife blade 104 for grinding the transferred ice pieces, and an outlet 103 for discharging the ice pieces to the dispenser 80 of the ice bucket 100 may be disposed.

More specifically, ice pieces discharged through the outlet 103 may fall to the dispensing space 81 through the chute 83 of the dispenser 80. Accordingly, the outlet 103 of the ice bucket 100 may be located higher than at least the entrance of the chute 83.

At least one area of storage space of the ice bucket 100 may be located lower than the outlet 103 of the ice bucket 100.

The transfer apparatus 110 may transfer ice pieces stored in the ice bucket 100 in an upwardly inclined front direction. That is, the transfer shaft 111 of the transfer apparatus 110 may be inclined upwardly in the front direction.

In the lower portion of the ice bucket 100, an ice lifting apparatus 120 may be disposed to raise ice pieces stored in the ice bucket 100 upward. The reason is because at least one area of the storage space of the ice bucket 100 is located lower than the outlet 103 of the ice bucket 100, and the transfer shaft 111 of the transfer apparatus 110 is inclined upwardly in the front direction, as described above.

The ice lifting apparatus 120 may include a lifting plate 121 to raise ice pieces, and a driving apparatus (not shown) to drive the lifting plate 121. The lifting plate 121 may be rotatably coupled with an area of the ice bucket 100.

The lifting plate 121 may lie on a bottom of the ice bucket 100, and when the driving apparatus is driven, the lifting plate 121 may rotate with respect to a rotation shaft 122 disposed at one end so that the other end is lifted.

The ice bucket 100 and the transfer motor 113 of the transfer apparatus 110 may be supported on a support member 140 provided in the freezing chamber 70. The support member 140 may be installed on the rear wall 17 of the main body 10.

As such, the ice-making space 134 may need to have a sufficient length in the front-rear direction such that at least one portion of the ice maker 90 and at least one portion of the ice bucket 100 can be accommodated in the ice-making space 134. Accordingly, the stepped portion 133 may also need to have a sufficient length in the front-rear direction. That is, a length A (see FIG. 3) in front-rear direction of the stepped portion 133 may be longer than half a length B (see FIG. 3) in front-rear direction of the middle wall 130.

Through the above-described configuration, since the ice maker 90 and the ice bucket 100 are disposed in the lower freezing chamber 70, instead of the upper refrigerating chamber 60, it is possible to increase use space of the refrigerating chamber 60 which stores a relatively larger amount of foods than the freezing chamber 70, and to make better space utilization.

Also, when the freezing chamber door 40 opens, at least one portions of the ice maker 90 and the ice bucket 100 may be not exposed to the outside since they are accommodated in the ice-making space 134, thereby improving the aesthetic sense.

Figure 5:
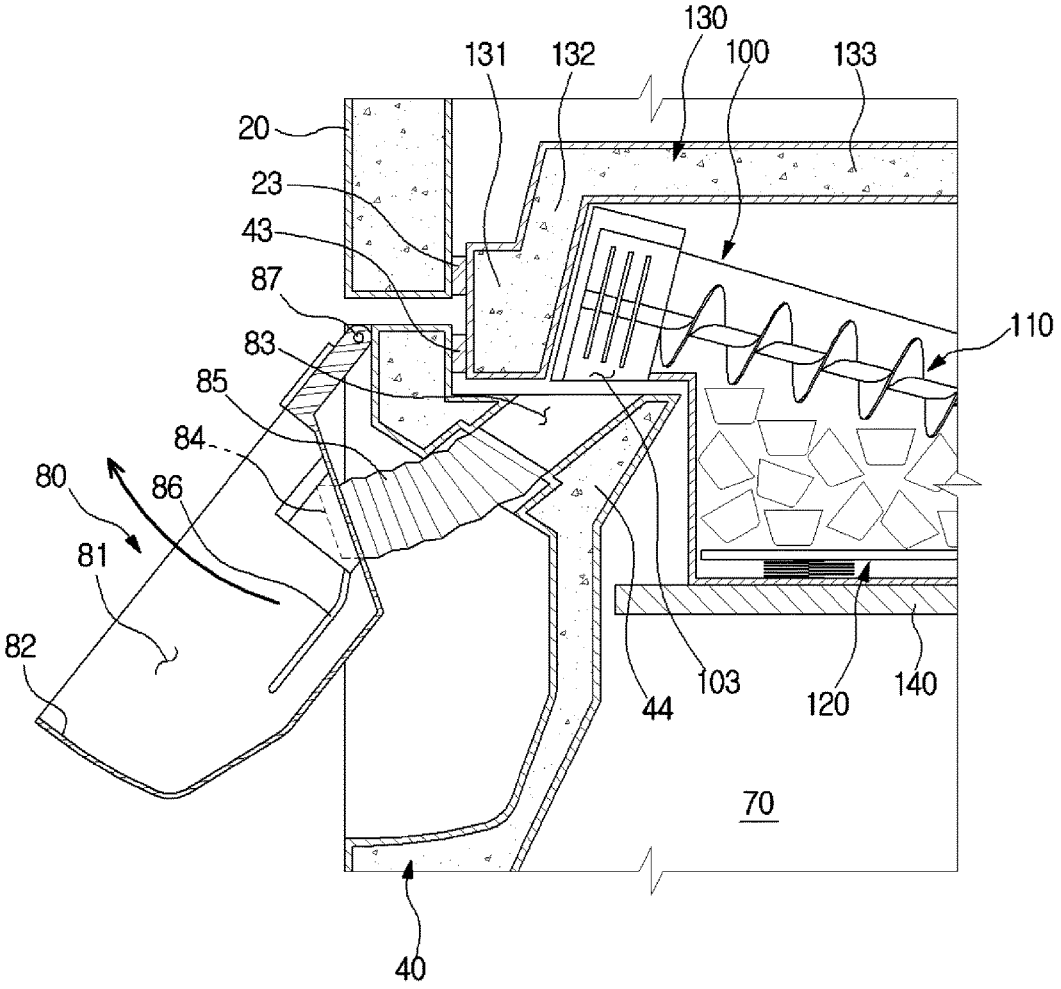
FIG. 5 is a view for describing operation of a dispenser of the refrigerator according to the first embodiment of the present disclosure.

FIG. 5 is a view for describing operation of a dispenser of the refrigerator according to the first embodiment of the present disclosure.

As described above, the dispenser 80 may be disposed in an uppermost portion of the freezing chamber door 40, for ease of use. However, for better ease of use, the container tray 82 or the ice discharging nozzle 84 of the dispenser 80 may pop up forward or upward when the dispenser 80 is used.

That is, the container tray 82 or the ice discharging nozzle 84 may closely contact the freezing chamber door 40 when the dispenser 80 is not used, and when the dispenser 80 is used, the container tray 82 or the ice discharging nozzle 84 may move forward or upward.

The container tray 82 or the ice discharging nozzle 84 may pop up through various structures. For example, as shown in FIG. 5, the container tray 82 or the ice discharging nozzle 84 may be tilting-rotatable with respect to the freezing chamber door 40.

The container tray 82 may be rotatable with respect to a rotation shaft 87 located at the upper end, and the ice discharging nozzle 84 may be coupled with the container tray 82 to be rotatable together with the container tray 82.

The flexible extention hose 85 connecting the chute 83 to the ice discharging nozzle 84 may be retractable in the shape of a pantograph, so that the chute 83 can be stably connected to the ice discharging nozzle 84 although the ice discharging nozzle 84 rotates.

Figure 6:
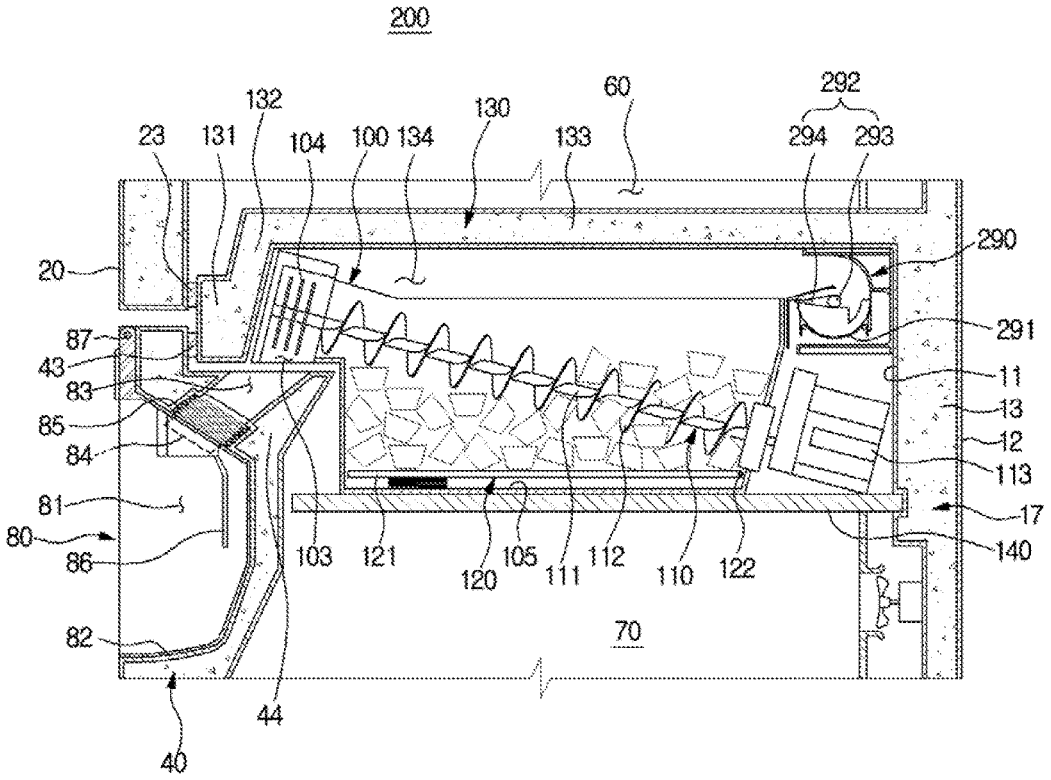
FIG. 6 is a side cross-sectional view showing a main portion of a refrigerator according to a second embodiment of the present disclosure.

FIG. 6 is a side cross-sectional view showing a main portion of a refrigerator according to a second embodiment of the present disclosure.

Hereinafter, the refrigerator according to the second embodiment of the present disclosure will be described with reference to FIG. 6. The same components as the first embodiment will be assigned the same reference numerals, and detailed descriptions thereof will be omitted.

In a refrigerator 200 according to the second embodiment of the present disclosure, an ice maker 290 may be disposed in a direction that is different from the direction in which the ice maker 90 according to the first embodiment is disposed.

More specifically, the ice maker 90 according to the first embodiment may extend in the front-rear direction, and the ice maker 290 according to the second embodiment may extend in a left-right direction.

The ice maker 290 may include an ice-making tray 291 having a plurality of ice-making cells to receive and freeze water, an ejector 292 to transfer ice pieces made in the ice-making tray 291 from the ice-making tray 291, and an ice transfer motor to provide a rotational force to the ejector 292.

The ejector 292 may include an ejector shaft 293 to rotate by receiving a rotational force from the ice transfer motor, and an ejector pin 294 protruding in a radial direction of the ejector shaft 293 to gather and raise ice pieces from the ice-making tray 291.

The ejector shaft 293 of the ice maker 290 may extend in the left-right direction.

If the ice maker 290 extends in the left-right direction, a length in left-right direction of the middle wall 130 may become relatively more or less longer, however, the storage space of the ice bucket 100 can increase since the ice bucket 100 can have a high height.

Figure 7:
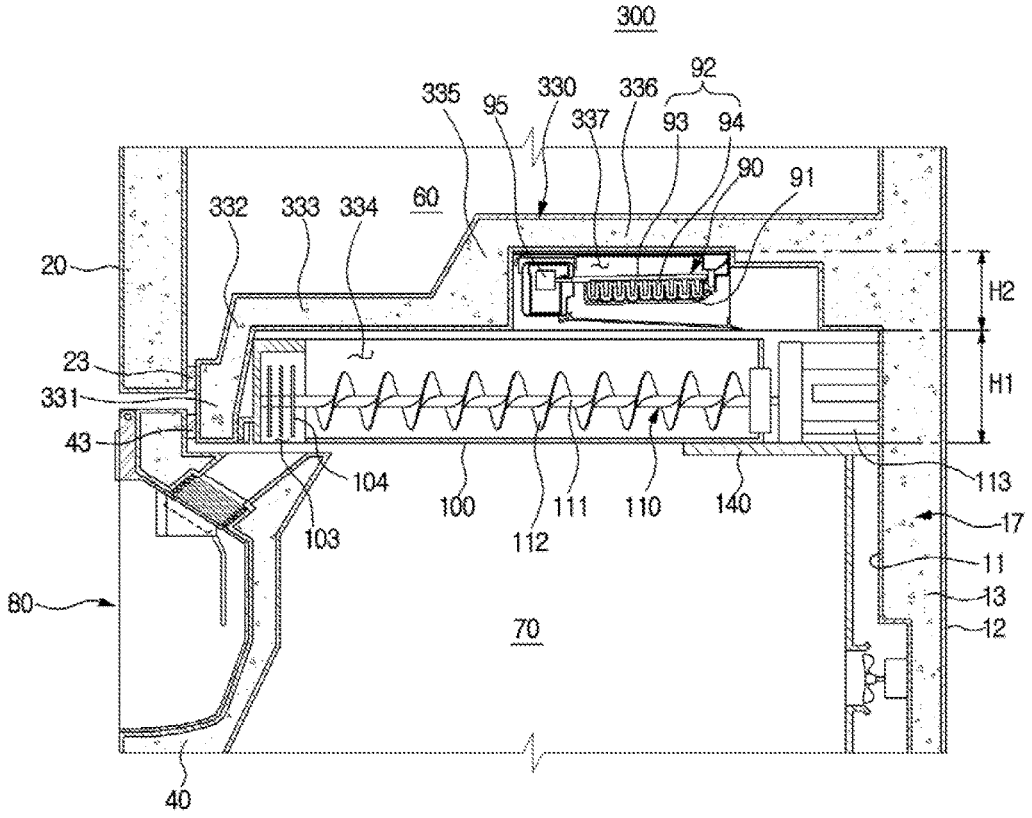
FIG. 7 is a side cross-sectional view showing a main portion of a refrigerator according to a third embodiment of the present disclosure.

FIG. 7 is a side cross-sectional view showing a main portion of a refrigerator according to a third embodiment of the present disclosure.

Hereinafter, the refrigerator according to the third embodiment of the present disclosure will be described with reference to FIG. 7. The same components as the above-described embodiments will be assigned the same reference numerals, and detailed descriptions thereof will be omitted.

A refrigerator 300 according to the third embodiment of the present disclosure may have a middle wall 330 partitioning inside space into the refrigerating chamber 60 and the freezing chamber 70.

The middle wall 330 may include a base portion 331, a first stepped portion 333 that is higher than the base portion 331 to form first ice-making space 334, and a second stepped portion 336 that is higher than the first stepped portion 333 to form second ice-making space 337.

The base portion 331, the first stepped portion 333, and the second stepped portion 336 may be nearly horizontal with respect to each other. The first stepped portion 333 may have a predetermined height difference H1 from the base portion 331, and the second stepped portion 336 may have a predetermined height difference H2 from the first stepped portion 333. The first and second height differences H1 and H2 may be height differences between a lowest surface of the base portion 331 and a lowest surface of the first stepped portion 333 and between the lowest surface of the first stepped portion 333 and a lowest surface of the second stepped portion 336.

The ice-making space 334 may be surrounded by the base portion 331, the first stepped portion 333, and the rear wall 17 such that the lower area opens. The second ice-making space 337 may be surrounded by the first stepped portion 333, the second stepped portion 336, and the rear wall 17 such that the lower area opens. The second ice-making space 337 may be formed above the first ice-making space 334. The first ice-making space 334 and the second ice-making space 337 may be an area of the freezing chamber 70.

A first extention portion 332 may be formed between the base portion 331 and the first stepped portion 333. The first extention portion 332 may be formed by bending the base portion 331, and the first stepped portion 333 may be formed by bending the first extention portion 332. The first extention portion 332 may be inclined or formed at right angles to the base portion 331.

A second extention portion 335 may be formed between the first stepped portion 333 and the second stepped portion 336. The second extention portion 335 may be formed by bending the first stepped portion 333, and the second stepped portion 336 may be formed by bending the second extention portion 335. The second extention portion 335 may be inclined or formed at right angles to the first stepped portion 333.

The doors 20 and 30 of the refrigerating chamber 60 and the doors 40 and 50 of the freezing chamber 70 may be supported on the base portion 331 in close contact with the base portion 331. That is, the gasket 23 of the refrigerating chamber doors 20 and 30 and the gasket 43 of the freezing chamber doors 40 and 50 may be in close contact with the base portion 331.

In the first ice-making space 334, at least one portion of the ice bucket 100 may be accommodated. The ice bucket 100 may be disposed horizontally. The ice bucket 100 may extend in the front-rear direction.

In the second ice-making space 337, at least one portion of the ice maker 90 may be accommodated. The ice maker 90 may extend in the front-rear direction. The ice maker 90 may be installed on the lower surface of the middle wall 330.

Through the above-described configuration, the ice maker 90 and the ice bucket 100 can be completely hidden in the middle wall 330.

Figure 8:
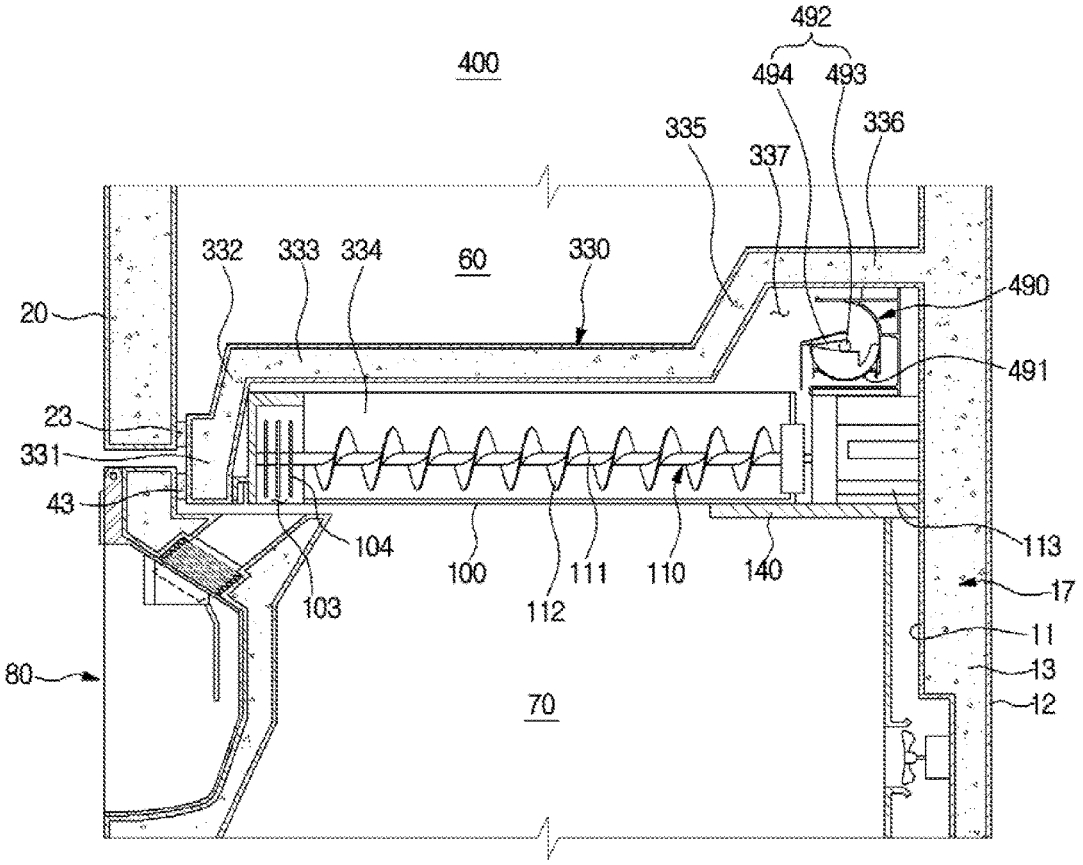
FIG. 8 is a side cross-sectional view showing a main portion of a refrigerator according to a fourth embodiment of the present disclosure.

FIG. 8 is a side cross-sectional view showing a main portion of a refrigerator according to a fourth embodiment of the present disclosure.

Hereinafter, the refrigerator according to the fourth embodiment of the present disclosure will be described with reference to FIG. 8. The same components as the above-described embodiments will be assigned the same reference numerals, and detailed descriptions thereof will be omitted.

In a refrigerator 400 according to the fourth embodiment of the present disclosure as described above, an ice maker 490 may be disposed in a direction that is different from the direction in which the ice maker 90 according to the third embodiment is disposed.

More specifically, the ice maker 90 according to the third embodiment may extend in the front-rear direction, and the ice maker 490 according to the fourth embodiment may extend in the left-right direction.

The ice maker 490 may include an ice-making tray 491 having a plurality of ice-making cells to receive and freeze water, an ejector 492 to transfer ice pieces made in the ice-making tray 491 from the ice-making tray 491, and an ice transfer motor to provide a rotational force to the ejector 492.

The ejector 492 may include an ejector shaft 493 to rotate by receiving a rotational force from the ice transfer motor, and an ejector pin 494 protruding in a radial direction of the ejector shaft 493 to gather and raise ice pieces from the ice-making tray 491.

The ejector shaft 493 of the ice maker 490 may extend in the left-right direction.

If the ice maker 490 extends in the left-right direction, a length in left-right direction of the middle wall 330 may become relatively more or less longer. However, since lengths in front-rear direction of the second stepped portion 336 and the second ice-making space 337 become relatively shorter, space utilization of the refrigerating chamber 60 can increase.

Figure 9:
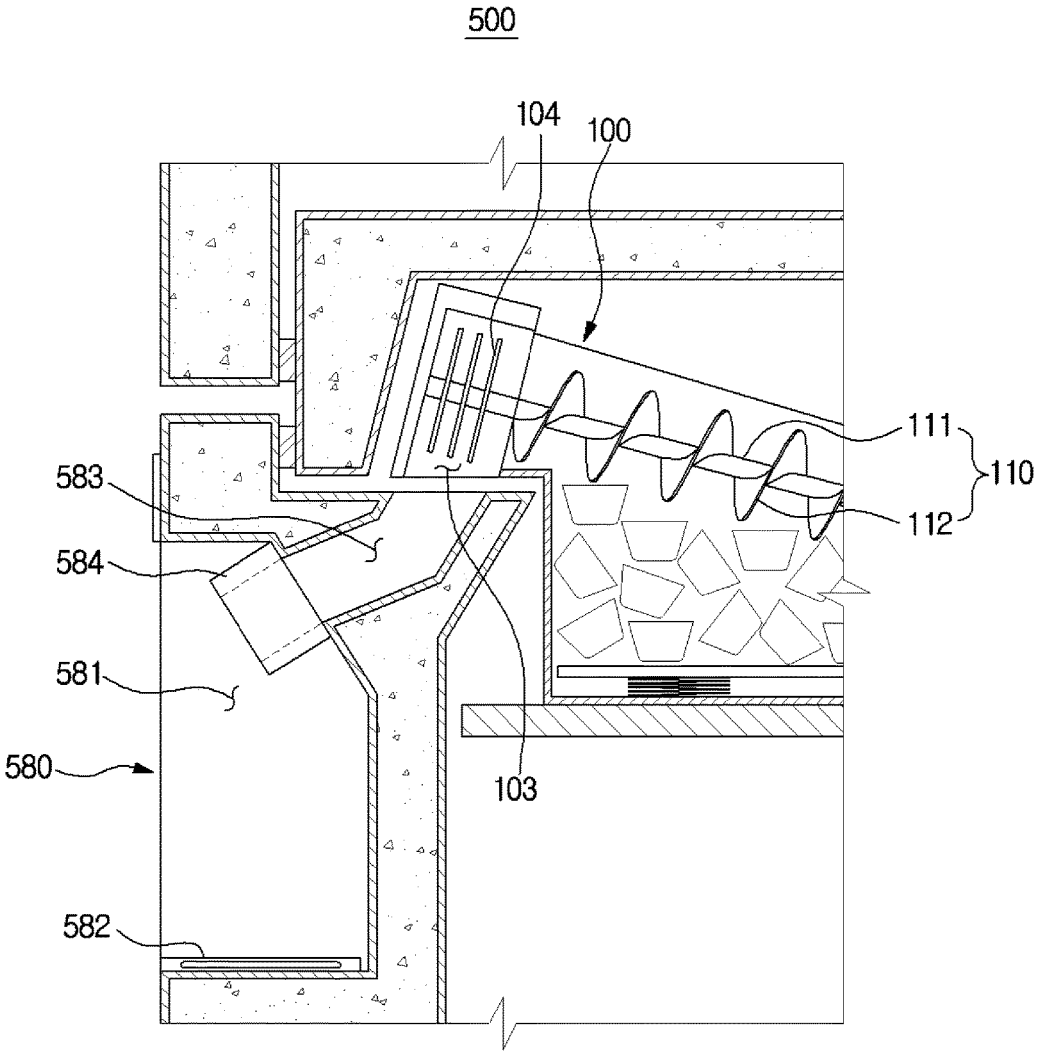
FIG. 9 is a side cross-sectional view showing a main portion of a refrigerator according to a fifth embodiment of the present disclosure.

FIG. 9 is a side cross-sectional view showing a main portion of a refrigerator according to a fifth embodiment of the present disclosure, and FIG. is a view for describing operation of a dispenser of the refrigerator according to the fifth embodiment of the present disclosure.

Figure 10:
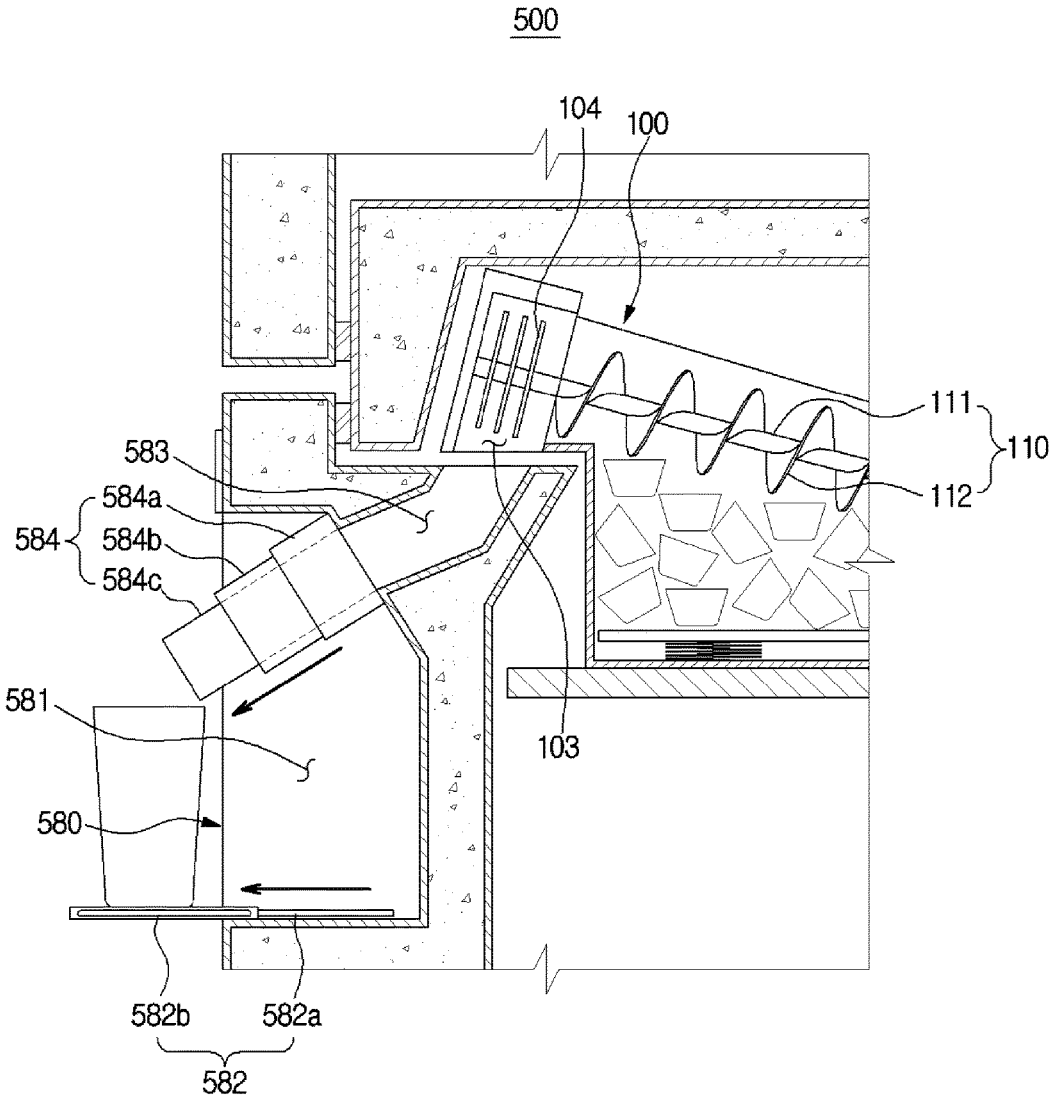
FIG. 10 is a view for describing operation of a dispenser of the refrigerator according to the fifth embodiment of the present disclosure.

Hereinafter, a dispenser according to another embodiment will be described with reference to FIGS. 9 and 10. As described above, the dispenser may be disposed in an uppermost portion of the freezing chamber door 40, for ease of use. However, for better ease of use, the container tray or the ice discharging nozzle of the dispenser may move forward or upward when the dispenser is used.

A container tray 582 supporting a container may include a fixed tray 582*a* fixed in dispensing space 581, and a moving tray 582*b* configured to be movable forward from the fixed tray 582*a*. That is, the container tray 582 may be retractable by a telescopic method.

The container tray 582 may be in an overlapping state when the dispenser is not used, and when the dispenser is used, the container tray 582 may extend forward.

A discharging nozzle 584 for discharging ice pieces may include a fixed nozzle portion 584*a* fixed in the dispensing space 581, a first moving nozzle portion 584*b* configured to be movable forward from the fixed nozzle portion 584*a*, and a second moving nozzle portion 584*c* configured to be movable forward from the first moving nozzle portion 584*b*. That is, the discharging nozzle 584 may be retractable by the telescopic method.

Through the configuration, the discharging nozzle 584 may be in an overlapping state when the dispenser is not used, and when the dispenser is used, the discharging nozzle 584 may extend forward.

The telescopic method that is applied to the container tray 582 and the discharging nozzle 584 may be an example of a moving structure for the container tray 582 and the discharging nozzle 584, and the container tray 582 and the discharging nozzle 584 may be movable by various methods, such as rotating, folding, sliding, etc.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

The invention claimed is:

1. A Bottom Mounted Freezer type refrigerator comprising:

a refrigerating chamber;

a freezing chamber located below the first storage chamber;

an ice maker configured to make ice pieces and provided in an upper portion of the freezing chamber;

an ice bucket configured to store the ice pieces made in the ice maker and provided in the freezing chamber, and a middle wall to partition inside space of the refrigerator into the refrigerating chamber and the freezing chamber, and the middle wall including a base portion, and a stepped portion located higher than the base portion to form an ice-making space, wherein at least one portion of the ice maker and at least one portion of the ice bucket are accommodated in the ice-making space.

2. The Bottom Mounted Freezer type refrigerator according to claim 1, wherein a length in a front-rear direction of the stepped portion is longer than half a length in a front-rear direction of the middle wall.

3. The Bottom Mounted Freezer type refrigerator according to claim 1, wherein the ice maker extends in a front-rear direction.

4. The Bottom Mounted Freezer type refrigerator according to claim 1, wherein the ice maker extends in a left-right direction.

5. The Bottom Mounted Freezer type refrigerator according to claim 1, wherein the ice bucket extends in a front-rear direction.

6. The Bottom Mounted Freezer type refrigerator according to claim 1, further comprising a transfer apparatus configured to transfer the ice pieces stored in the ice bucket.

7. The Bottom Mounted Freezer type refrigerator according to claim 6, wherein the transfer apparatus includes a transfer shaft inclined upwardly in a front direction.

8. The Bottom Mounted Freezer type refrigerator according to claim 1, further comprising an ice lifting apparatus configured to raise the ice pieces stored in the ice bucket upward.

9. The Bottom Mounted Freezer type refrigerator according to claim 1, wherein the stepped portion includes a first stepped portion located higher than the base portion to form a first ice-making space, and a second stepped portion located higher than the first stepped portion to form a second ice-making space, and wherein the at least one portion of the ice bucket is accommodated in the first ice-making space, and the at least one portion of the ice maker is accommodated in the second ice-making space.

10. The Bottom Mounted Freezer type refrigerator according to claim 1, further comprising a refrigerating chamber door to open or close the refrigerating chamber and a freezing chamber door to open or close the freezing chamber, and wherein the freezing chamber door includes a dispenser which the stored ice pieces in the ice bucket is discharged therethrough.

11. The Bottom Mounted Freezer type refrigerator according to claim 1, further comprising a dispenser provided in a position corresponding to a position of the ice bucket and to discharge the stored ice pieces in the ice bucket therethrough.

* * * * *